US008828348B2

(12) United States Patent
Miller et al.

(10) Patent No.: US 8,828,348 B2
(45) **Date of Patent: *Sep. 9, 2014**

(54) REDUCED PUFFING NEEDLE COKE FROM COAL TAR

(75) Inventors: Douglas J. Miller, North Olmsted, OH (US); Ching-Feng Chang, Strongville, OH (US); Irwin C. Lewis, Oberlin, OH (US); Aaron Tomasek, Wooster, OH (US); Richard L. Shao, North Royalton, OH (US)

(73) Assignee: GrafTech International Holdings Inc., Parma, OH (US)

( * ) Notice: Subject to any disclaimer, the term of this patent is extended or adjusted under 35 U.S.C. 154(b) by 540 days.

This patent is subject to a terminal disclaimer.

(21) Appl. No.: 13/187,952

(22) Filed: Jul. 21, 2011

(65) Prior Publication Data

US 2011/0274136 A1 Nov. 10, 2011

Related U.S. Application Data

(62) Division of application No. 12/132,215, filed on Jun. 3, 2008, now Pat. No. 8,007,658.

(51) Int. Cl.

| | |
|---|---|
| ***C01B 31/00*** | (2006.01) |
| ***C10B 55/00*** | (2006.01) |
| ***C10C 1/18*** | (2006.01) |
| ***C10B 57/04*** | (2006.01) |
| ***C10C 1/20*** | (2006.01) |

(52) U.S. Cl.

CPC . *C10B 55/00* (2013.01); *C10C 1/18* (2013.01); *C10B 57/045* (2013.01); *C10C 1/20* (2013.01)

USPC ..... 423/445 R

(58) Field of Classification Search

CPC ..... C01B 31/00; C10L 5/02

USPC ..... 423/445 R

See application file for complete search history.

(56) References Cited

U.S. PATENT DOCUMENTS

| | | | | |
|---|---|---|---|---|
| 2,814,076 | A | 11/1957 | Gartland | |
| 3,363,401 | A | 1/1968 | Jean Solinhac et al. | |
| 3,609,099 | A | 9/1971 | Mickelson | |
| 3,928,169 | A | 12/1975 | Conroy et al. | |
| 3,976,729 | A | 8/1976 | Lewis et al. | |
| 3,995,014 | A | 11/1976 | Lewis | |
| 4,017,327 | A | 4/1977 | Lewis et al. | |
| 4,026,795 | A | 5/1977 | Okamoto et al. | |
| 4,312,745 | A | 1/1982 | Hsu et al. | |
| 4,405,439 | A | 9/1983 | Simone | |
| 4,521,299 | A | 6/1985 | Givens et al. | |
| 4,814,063 | A | 3/1989 | Murakami et al. | |
| 5,059,301 | A | 10/1991 | Roussel et al. | |
| 5,068,026 | A | 11/1991 | Jager et al. | |
| 2,104,518 | A | 4/1992 | Jager | |
| 5,118,287 | A | 6/1992 | Orac et al. | |
| 5,162,286 | A | 11/1992 | MacDowall | |
| 5,167,796 | A | 12/1992 | Didchenko et al. | |
| 5,259,947 | A | 11/1993 | Kalback et al. | |
| 5,286,371 | A | 2/1994 | Goval et al. | |
| 5,538,929 | A | 7/1996 | Sudhakar et al. | |
| 5,817,229 | A | 10/1998 | Sudhakar et al. | |
| 5,900,189 | A | 5/1999 | Kawano et al. | |
| 6,717,020 | B2 | 4/2004 | Murkami | |
| 7,964,173 | B2 * | 6/2011 | Oyama et al. | 423/445 R |
| 8,530,094 | B2 * | 9/2013 | Miller et al. | 429/231.8 |
| 8,658,315 | B2 * | 2/2014 | Miller et al. | 429/231.8 |
| 2008/0093260 | A1 | 4/2008 | Koseoglu | |

FOREIGN PATENT DOCUMENTS

| | | |
|---|---|---|
| CN | 1145089 A | 3/1997 |
| JP | 59-122585 a | 7/1984 |
| JP | 59122585 | 7/1984 |
| JP | 60-149690 | 8/1985 |
| JP | 03-143989 | 6/1991 |
| WO | 2007074938 | 7/2007 |

OTHER PUBLICATIONS

Adams, H.A., "Delayed Coking—Practice and Theory" in Introduction to Carbon Technologies, Edited by H. Marsh, E. Heintz and F. Rodriques-Reinoso, University of Alicante Press (1997), p. 491.

Chunshan Song, "An overview of new approaches to deep desulfurization for ultra-clean gasoline, diesel fuel and jet fuel" (2003) Elsevier, Pennsylvania University, University Park, PA, USA.

Clar, E., "Polycyclic Hydrocarbons," Edited by Academic Press, New York, NY (1964).

Edwards, W.F., et al., Abstracts of Carbon 2004, Providence, R.I. (2004).

Greinke, R.A., "Chemistry and Physics of Carbon," edited by P.A. Thrower, Marcel Dekker, New York, N.Y. vol. 24 (1994).

Heintz, E.A., "The Characterization of Petroleum Coke", Carbon vol. 34 pp. 699-709 (1996).

Hurt, R.H. and Hu, Y., Carbon 37, 281 (1999), Division of Engineering, Brown University, Providence, RI, USA.

Hurt, R.H. and Hu, Y., Carbon 39, 887 (2001), Division of Engineering, Brown University, Providence, RI, USA.

(Continued)

*Primary Examiner* — Stuart Hendrickson

(57) ABSTRACT

A reduced puffing needle coke is formed, which includes a lesser amount of nitrogen within the coke so that carbon articles produced from such coke experience minimal expansion upon heating to graphitization temperatures.

6 Claims, 1 Drawing Sheet

(56) References Cited

OTHER PUBLICATIONS http://www.process-nmrcom/liquidanalysis(2).html Analytical liquid-state NMR applications, Process NMR Associates LLC (2003).
Kim, Jae Hyung et al., "Ultra-deep desulfurization and denitrogenation of diesel fuel by selective absorption over three different absorbents: A study of an adsorptive selectivity and mechanism" (2005) Elsevier, The Pennsylvania State University, University Park, PA, USA.
King, B., 1H and 13C Interpretation tutorial, http://www.wfu.edu/ylwong/chem/nmrc13/c13chemical shift.html- 2003, Wake Forest University.
Lewis, R.T., Extended Abstracts for the 12th Biennial Carbon Conference, (1975) p. 215.
Lewis, R.T., et al., Carbon vol. 25, p. 289 (1987), Printed in Great Britain, Pergamon Journals Ltd.
Lewis, I.C., et al., "Polynuclear Aromatic Compounds," edited by L.E. Eben, American Chemical Society, p. 269 (1988).
Nazem, F. and Lewis, I.C., Mol., Cryst., Liq. Cryst., vol. 139, p. 195, (1886), Gordon and Breach Science Publishers S.A., USA.
Nelson, W.L., "Petroleum Refinery Engineering," Fourth Edition, McGraw-Hill (1958).
Ramsey, B.G., et al., Journal of Organometallic Chemistry vol. 690, p. 962 (2005), Center for Molecular Analysis, Department of Chemistry, Carnegie Mellon University, Pittsburgh, PA, USA.
Rand, S., "Handbook of Composites" vol. 1 495 (1985), University of Sheffield, United Kingdom.
Riggs, D.M., et al., Carbon Conference (1980), p. 326, Rensselaer Polytechnic Insitute, Troy, NY, USA.
Rodriguez, J., et al., Evaluation of a delayed coking process by 1H and 13C n.m.r. spectroscopy: 2. Detailed interpretation of liquid n.m.r. spectra. Fuel 1994, vol. 73, pp. 1870-1875, University of Pittsburgh, Pittsburgh, PA, USA.
Sano, Y. et al., "Two-Step Absorption Process for Deep Desulfurization of Diesel Oil", Fuel 84, pp. 903-910 (2005).
Wagner, G. et al., "Capacitance Bridge Measurements of Thermal Expansion", 1986 International Carbon Conference in Baden-Baden Germany.

* cited by examiner

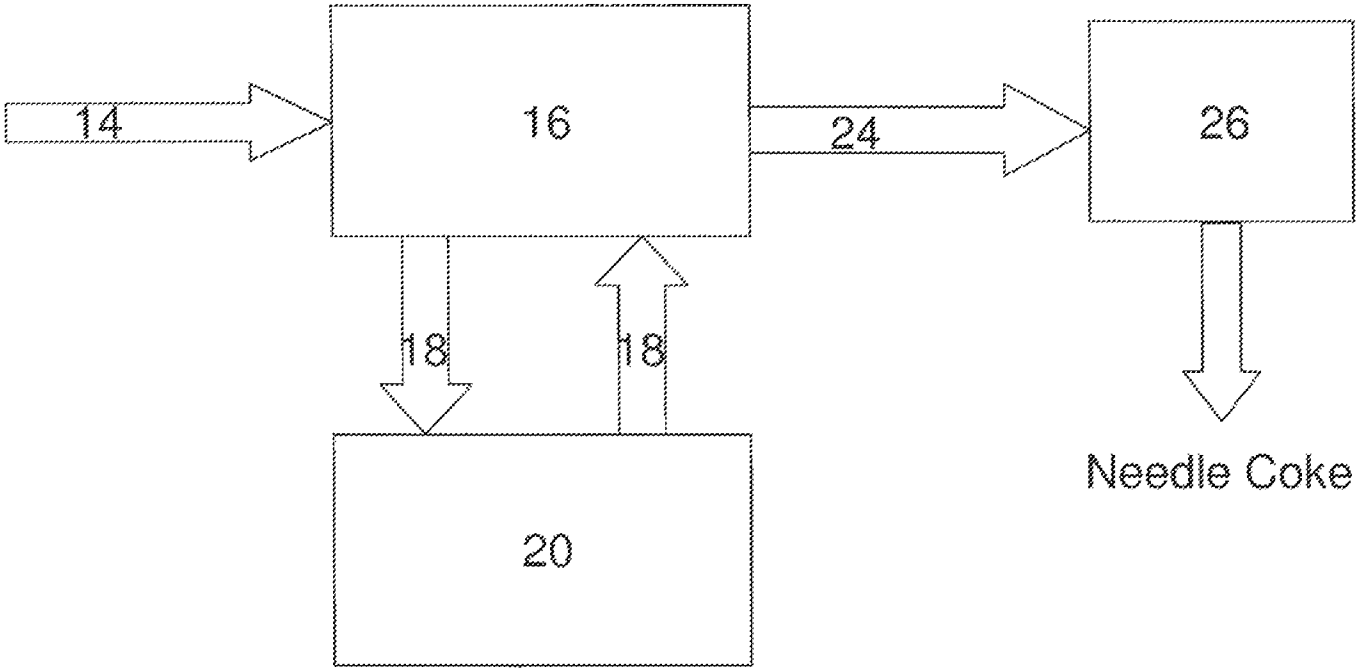
14
16
18
18
20
24
26
Needle Coke

REDUCED PUFFING NEEDLE COKE FROM COAL TAR

BACKGROUND OF THE INVENTION

1. Technical Field

The present invention relates to needle coke useful for applications including forming graphite electrodes. More particularly, the present invention relates to a process for producing needle coke exhibiting reduced puffing characteristics from a coal tar starting material. The invention also includes the reduced puffing needle coke.

2. Background Art

Carbon electrodes, especially graphite electrodes, are used in the steel industry to melt both the metals and supplemental ingredients used to form steel in electrothermal furnaces. The heat needed to melt the substrate metal is generated by passing current through a plurality of electrodes and forming an arc between the electrodes and the metal. Currents in excess of 100,000 amperes are often used.

Electrodes are typically manufactured from needle coke, a grade of coke having an acicular, anisotropic microstructure. For creating graphite electrodes that can withstand the ultra-high power throughput, the needle coke must have a low electrical resisitivity and a low coefficient of thermal expansion (CTE) while also being able to produce a relatively high-strength article upon graphitization.

The specific properties of the needle coke may be dictated through controlling the properties of the coking process in which an appropriate carbon feedstock is converted into needle coke. Typically, the grade-level of needle coke is a function of the CTE over a determined temperature range. For example, premium needle coke is usually classified as having an average CTE of from about 0.00 to about $0.30\times10^{-6}$/C. ° over the temperature range of from about 30° C. to about 100° C. while regular grade coke has an average CTE of from about 0.50 to about $5.00\times10^{-6}$/C. ° over the temperature range of from about 30° C. to about 100° C.

To evaluate the CTE of a coke, it is first calcined to a temperature of about 1,000 to 1,400° C. It is then admixed with a molten pitch binder and the pitch/coke mixture is extruded to form a green electrode. The electrode is then baked to about 800-900° C. and then heated from 2,800-3,400° C. to effect graphitization. The CTE is measured on the graphitized electrode using either a dilatometer or the capacitance method (the capacitance method is described in a publication titled "Capacitance Bridge Measurements of Thermal Expansion" presented at the 1986 International Carbon Conference in Baden-Baden Germany. The procedure for evaluating coke CTE is found in publication by E. A. Heintz, Carbon Volume 34, pp. 699-709 (1996), which are incorporated herein by reference in their entirety).

In addition to low CTE, a needle coke suitable for production of graphite electrodes preferably has a very low content of sulfur and nitrogen. Sulfur and nitrogen in the coke generally remain after calcination and are only completely removed during the high temperature graphitization process.

If the needle coke contains too great a degree of nitrogen or sulfur, the electrode will experience "puffing" upon graphitization. Puffing is the irreversible expansion of the coke particles which creates cracks or voids within the electrode, diminishing the electrode's structural integrity as well as drastically altering both its strength and density.

The degree of puffing generally correlates to the percentage of nitrogen and sulfur present in the needle coke. Both the nitrogen and sulfur atoms are bonded to the carbon within the feedstock through covalent bonding typically in a ring arrangement. The nitrogen-carbon and sulfur-carbon bonding is considerably less stable than carbon-carbon bonding in high temperature environments and will rupture upon heating. This bond rupture results in the rapid evolution of nitrogen and sulfur-containing gases during high temperature heating, resulting in the physical puffing of the needle coke. Another source of puffing may also involve the rupture of sulfur to sulfur bonds.

A variety of methods have been attempted to reduce the puffing of needle coke during the graphitization process, with most of the focus directed to the effects of sulfur. The approaches used involve either treating the needle coke feedstock with a catalyst and hydrogen to remove sulfur prior to coking or to introduce chemical additives to the coke which inhibit the puffing process.

One such approach has been the use of an inhibitor additive to either the initial feedstock or the coke mixture prior to the graphitization to an electrode body. U.S. Pat. No. 2,814,076 teaches of the addition of an alkali metal salt to inhibit the puffing. Such salts are added immediately prior to graphitizing an electrode. Notably, sodium carbonate is added by impregnating the article through a sodium carbonate solution.

U.S. Pat. No. 4,312,745 also describes the use of an additive to reduce the puffing of sulfur-containing coke. Iron compounds, such as iron oxide are added to the sulfur-containing feedstock with the coke being produced through the delayed-coking process. However, this process can increase the CTE of the coke.

Orac et al. (U.S. Pat. No. 5,118,287) discloses the addition of an alkali or alkaline earth metal to the coke at a temperature level above that where the additive reacts with the carbon but below the puffing threshold to thereby preclude puffing.

Jager (U.S. Pat. No. 5,104,518) describes the use of sulphonate, carboxylate or phenolate of an alkaline earth metal to a coal tar prior to the coking step to reduce nitrogen puffing in the 1400° C.-2000° C. temperature range. Jager et al. (U.S. Pat. No. 5,068,026) describes using the same additives to a coke/pitch mixture prior to baking and graphitization, again to reduce nitrogen-based puffing.

Other attempts have been made to preclude the puffing of electrodes through the use of carbon additives or various hydro-removal techniques. In U.S. Pat. No. 4,814,063, Murakami et al. describes the creation of an improved needle coke through the hydrogenation of the starting stock in the presence of a hydrogenation catalyst. Subsequently, the hydrogenated product undergoes thermal cracking with the product being cut into different fractions. In Japan Patent Publication 59-122585, Kaji et al. describes hydrorefining a pitch in the presence of a hydrogenating catalyst to remove nitrogen and sulfur, followed by coking of the pitch to give a reduced puffing needle coke.

Goval et al. (U.S. Pat. No. 5,286,371) teaches of passing a feedstock through a hydrotreating reaction zone to produce a hydrotreated residual product wherein the product can undergo a solvent extraction process.

Didchenko et al. (U.S. Pat. No. 5,167,796) teaches the use of a large pore size hydrotreating catalyst with hydrogen to remove sulfur from a petroleum decant oil prior to coking.

Unfortunately, needle coke produced by the prior art usually fails to address the problems of nitrogen remaining in the needle coke that is to be graphitized into an electrode. The additives used to reduce the puffing characteristics of needle coke counteract the sulfur components which would otherwise be liberated from the needle coke but fail to preclude puffing resulting from the nitrogen components. Since nitrogen puffing is not controlled, the use of such additives can result in a finished electrode product of inferior quality as the electrode will likely possess both a lower density and a lower strength. The addition of chemicals to the coke feedstocks or to the pitch can lead to the presence of solids during mesophase formation which could raise the CTE of the derived coke. Furthermore, hydrogenation processes require a significant energy input as high temperatures needed for extended heat treatments to remove a substantial amount of nitrogen from the feedstock. Furthermore, hydrogen must be applied for the hydrogenation and accompanying removal of the sulfur and nitrogen from the feedstock.

What is desired, therefore, is a process for producing reduced puffing needle coke which does not require the use of puffing inhibitor additives and therefore does not decrease the strength and density of the final electrode. Furthermore, a process is desired requiring less thermal energy for the removal of nitrogen from the feedstock as well as no input stream of hydrogen. Indeed, a process which is superior in removing nitrogen from a feedstock for the production of needle coke and/or binder pitch for producing a graphitized electrode article has been found to be necessary for producing high strength, reduced-puffing electrodes. Also desired is the inventive reduced-puffing needle coke with reduced nitrogen content for the production of graphite electrodes. Furthermore, since coal-based feedstocks for needle coke, such as coal tar, have high nitrogen contents, a process is desired which would allow he use of such feedstocks for production of needle cokes suitable for high performance graphite electrodes.

BRIEF DESCRIPTION

The present invention provides a process which is uniquely capable of reducing the nitrogen content of a coal tar feedstock for creating reduced-puffing needle coke. The inventive process provides a method where neither additives nor high temperature hydrogenation steps are necessary to remove the nitrogen from the coal tar feedstock in the process of making needle coke. Such reduced-puffing needle coke resists expansion during graphitization and provides electrode articles with improved density and strength characteristics, a combination of needle coke characteristics not heretofore seen. In addition, the inventive process for producing needle coke provides a reduced-puffing needle coke from coal tar without the excessive expenditures of both hydrogen and thermal energy.

More particularly, the inventive process reduces the nitrogen present in the coal tar feedstock by means of a nitrogen removal system. The nitrogen removal system allows the nitrogen-containing components of the coal tar feedstock to be physically removed with the use of an adsorbent. Such nitrogen removal systems allow for the entering coal tar feedstock stream to have a nitrogen content of from about 0.4% by weight to about 2% by weight and will produce a calcined needle coke product having a nitrogen content of from about 0.03% to about 0.4% by weight. An important characteristic of this inventive process is the ability for the nitrogen removal process to function throughout a wide range of temperatures. Specifically the nitrogen removal system can function at ambient conditions as well as the standard temperatures required for the flow of a coal tar feed stock. For the removal of nitrogen, the coal tar feedstock can flow through a variety of reactor designs, including absorption beds and multiple reactors arranged for the continuous treatment of the coal tar feedstock while a reactor is offline.

The inventive nitrogen removal system for producing reduced puffing needle coke carbon should use a nitrogen removal method which can operate with out the addition of excessive thermal energy or hydrogen gas to facilitate nitrogen removal from the coal tar feedstock. The nitrogen removal system preferably includes an activated carbon article as the primary nitrogen removal element of the nitrogen removal system. The activated carbon article acts as a molecular sieve adsorbent which physically removes the nitrogen containing components from the coal tar feedstock as the feedstock passes through the nitrogen removal system.

Alternatively, the nitrogen removal system may contain other suitable absorbent materials including activated carbon fibers, activated alumina, silica gel, silica alumina and xeolites which can optimally reduce the nitrogen content of the feedstock to about 0.4% or less by weight, preferably about 0.2% or less by weight, and more preferably, down to or below about 0.03% by weight.

In addition, it has been found highly advantageous to have a restoration system for the nitrogen removal system. The restoration system acts to regenerate the removal properties of the nitrogen removal system, through the disengagement of the nitrogen containing components from the removal system. In nitrogen removal systems incorporating an activated carbon structure, the restoration system removes the nitrogen components from the nitrogen binding sites of the activated carbon. Similarly, in nitrogen removal systems incorporating alumina or silica-based adsorbents, the restoration system removes the nitrogen components from the active adsorption sites, freeing the active sites for future nitrogen adsorption.

The coal tar feed stock fed into the nitrogen removal column should be relatively free from quinoline insolubles (QI) as the QI components can inhibit the formation of needle coke. Specifically, QI components (especially small particles of QI) become bonded to the spherules during the coking process, precluding proper mesophase growth.

After the coal tar feedstock exits the nitrogen removal column, the feedstock enters a delayed coking unit for the conversion of treated coal tar feedstock to needle coke. Delayed coking, as known in the art, is the thermal cracking process in which the liquid coal tar feedstock is converted into the solid needle coke. The delayed coking of the reduced puffing coal tar feedstock should be a batch-continuous process where multiple needle coke drums are utilized so that one drum is always being filled with feedstock. Alternatively, the process may be a semi continuous process.

An object of the invention, therefore, is a process for using a coal tar feedstock to create reduced puffing needle coke to be employed in applications such as production of graphite electrodes.

Another object of the invention is a process for creating reduced puffing needle coke having a nitrogen reducing system incorporating activated carbon as a nitrogen compound adsorbing agent.

Still another object of the invention is a process for creating reduced puffing needle coke having a nitrogen reducing system incorporating an alumina or silica-containing adsorbent for the removal of nitrogen compounds from the coal tar feedstock.

Yet another object of the invention is a reduced puffing coke which contains substantially less nitrogen and exhibits very little or no expansion upon graphitization.

These aspects and others that will become apparent to the artisan upon review of the following description and can be accomplished by providing a coal tar feedstock having an average nitrogen content of from about 0.5% to about 2% by weight and treating the coal tar feedstock with the nitrogen removal system under relatively mild conditions at temperatures no greater than 140° C. One embodiment of the process advantageously reduces the nitrogen content of the coal tar feedstock to about 0.4% or less by weight, preferably about 0.2% or less, more preferably to about or below 0.03%, allowing the feedstock to be converted into reduced-puffing needle coke. Preferably the coal tar feedstock is converted from a viscous liquid to a liquid from which the nitrogen-containing species can more readily be adsorbed.

The disclosed process can utilize a nitrogen removal system with a variety of adsorbing agents, especially activated carbon as well as activated alumina, silica gels and silica-alumina and xeolites. Such adsorbents are readily available from commercial sources such as Aldrich Chem. Co. and have been used in chromatographic separations and for separating heterocyclic components from petroleum-derived diesel oil. (Y. Sano et al., Fuel 84, 903 (2005))

It is to be understood that both the foregoing general description and the following detailed description provide embodiments of the invention and, when read in light of the attached drawing, are intended to provide an overview or framework of understanding to nature and character of the invention as it is claimed.

BRIEF DESCRIPTION OF THE DRAWING

FIG. 1 is a schematic flow-diagram of the process to produce reduced puffing needle coke from coal tar feedstock.

DETAILED DESCRIPTION OF THE PREFERRED EMBODIMENTS

Reduced-puffing needle coke is prepared from coal tar feedstock, with quinoline insolubles (QI) free coal tar feedstock being preferred. QI constituents are solid particles, of less than about 1 micron to about 50 microns in diameter, which are present in the coal tar derived from the coking of coal. Specifically, the presence of QI prevents the coalescence of the mesophase into large domains, precluding a high quality needle coke from being formed. As such, when QI are present in the starting coal tar feedstock, the insolubles preferably should be removed to make reduced puffing needle coke.

Referring now to FIG. 1, QI containing coal tar 10 flows into the QI removal system 12 for the removal of QI. As known to those skilled in the art, quinoline insolubles can be removed from coal tar through a solvent extraction process, or solids separation process such as that described in Japanese Patent disclosure JP62124188. Initial coal tar 10 can have a QI of from about 2% to 20% by weight prior to the treatment by the QI removal system. Through treatment by the QI removal system utilizing a solvent extraction method, QI free coal tar 14 will have a QI percentage by weight of from about 0.01% to about 0.5%.

Upon treatment by the QI removal system 12, the QI free coal tar 14 is directed toward the nitrogen removal system 16. As is necessary for the specific nitrogen removal system 16, the QI free coal tar 14 can be heated to reduce its viscosity and to facilitate the best possible removal of nitrogen components during the processing within the nitrogen removal system 16. Specifically, slight heating can be utilized to decrease the viscosity of the coal tar and provide better contact between the tar and the reactive surfaces within the nitrogen removal system. Alternately, the viscosity of the coal tar can be decreased by mixing with and dilution by a solvent. Treatment of certain coal tar feedstocks may require both dilution with a solvent and heating to bring about the most efficient use of the nitrogen removal system.

In one embodiment the nitrogen removal system 16 comprises a column loaded with nitrogen removing material. The system may include one or more columns in a parallel arrangement. Multiple columns are ideal so that when one goes offline, nitrogen removal system 16 can still be continuously operated.

In one alternative, the components of the nitrogen removal system are fixed-bed (static) columns. In these units the nitrogen-removing material is fixed and the column must be taken off-line from coal tar processing to remove or regenerate the nitrogen-removing material. In another alternative, the nitrogen removal system contains a moving bed. In moving bed type columns, the unit contains a fluidized bed of nitrogen removing material wherein the material is continuously removed and added to maintain desired activity of the nitrogen removal system.

One type of nitrogen removing material is activated carbon, carbon that has been treated to possess a ramified pore system throughout the carbon structure, resulting in a large internal specific surface area. Specifically, the activated carbon in the nitrogen removal system 16 can have a surface area in excess of 200 $m^2/g$, with upper limits above about 3000 $m^2/g$. Such activated carbon for the nitrogen removal system 16, can be created from a variety of organic sources, including, but not limited to hardwoods, coal and coke products, cellulosic materials, and polymer resins. Additionally, the activated carbon can be activated carbon fibers, rather than typical activated carbon in granular formation. Typically, the activated carbon will have a trimodal pore distribution of micropores, mesopores, and macropores, with the pore size ranging from less than 2 nanometers for micropores to greater than 50 nm for macropores.

The primary means of removing nitrogen components from the coal tar feedstock within nitrogen removal system 16 is through adsorption by activated carbon. The two primary physical considerations of the activated carbon to consider in best selecting activated carbon for the adsorption of nitrogen components from a coal tar feedstock are the total surface area and pore structure. A large total surface of the activated carbon permits the availability of more active sites for the interaction with nitrogen components of the coal tar feedstock. Furthermore, both the macropores and the mesopores of the activated carbon provide mechanical exclusion of particles from becoming adsorbed within the ramified pore system of the activated carbon, while allowing smaller molecules to the inner micropores. The pore size physically limits the particular size of the molecule that which can reach the inner micropores of the activated carbon and thus be removed from the coal tar feedstock. The nitrogen-containing components, within coal tar, are sufficiently small in molecular size to reach the micropores of the activated carbon and become trapped and thereby removed from the coal tar.

While any form of activated carbon is effective at nitrogen removal in accordance with the present invention, pH-neutral activated carbon has been found to be especially effective. In addition, in another embodiment of the use of activated carbon in nitrogen removal system 16, acid-washed (or partially neutralized) activated carbon or activated carbon with surface functional groups having high nitrogen affinity is employed, either in substitution for pH-neutral activated carbon, or in combination therewith. Reference herein to "activated carbon" refers to activated carbons generally or to any or all of pH-neutral activated carbon, acid-washed or partially neutralized activated carbon, activated carbon with surface functional groups, or combinations thereof The use of acid-washed or partially neutralized activated carbon may be more effective at the removal of nitrogen-containing heretocyclic compounds (typically Lewis bases) from oils and tars. The acid-washed or partially neutralized activated carbon would have additional acidic functional groups as compared with pH-neutral activated carbon, which can make bonding interactions with nitrogen-containing species more likely. Activated carbons having surface functional groups with high nitrogen affinity, such as those impregnated with metals such as $NiCl_2$, can more effectively form metal species complexes with nitrogen species and so trap the nitrogen compounds within the carbon.

An additional component of nitrogen removal system 16 is the structural elements which maintain the activated carbon while the coal tar passes through the bed. Typical to adsorption with activated carbon, the activated carbon may require a substantial retention time with the coal tar feedstock for the removal of nitrogen. The coal tar may be in contact with the activated carbon on the order of hours to adequately remove nitrogen from the feedstock. To make possible the immobility of the activated carbon, a fixed bed type column is a preferred embodiment, as this style is commonly used for the adsorption from liquids. In an additional embodiment, the activated carbon can be housed in a moving bed column wherein the activated carbon is slowly withdrawn as it becomes spent.

For the optimal removal of nitrogen from QI free Coal Tar 14 by the nitrogen removal system 16, processing parameters can be designed for best reaction conditions between the activated carbon and the coal tar. As adsorption usually increases with decreasing temperature, QI free Coal Tar 14 can be fed into nitrogen removal system 16 at the lowest temperature consistent with adequate flow of the coal tar. Furthermore, the pH can optionally be altered to also facilitate better adsorption, typically allowing the nitrogen within the coal tar to be in a more adsorbable condition.

Other key process considerations include the time in which the coal tar feedstock is in contact with the activated carbon. Adsorption is dependent upon the total time in which the nitrogen components are able to be in contact with the activated carbon. Therefore, increasing contact time between the activated carbon and the coal tar feedstock allows for a greater proportion of the nitrogen to be removed. Methods of increasing contact time include reducing the flow rate of the coal tar feedstock, increasing the amount of activated carbon within the bed, or providing activated carbon with a greater surface area.

Upon diminished performance of the adsorption of nitrogen from the coal tar feedstock, the activated carbon component may be either discarded or reactivated for continued use. Dependant upon the costs of thermal energy and the current price of activated carbon, economics might dictate the disposal of the activated carbon and the deposit of fresh activated carbon within the static beds of nitrogen removal system 16. If nitrogen removal system 16 includes one or more moving bed column, the activated carbon can continuously be drawn off as the carbon becomes spent. Otherwise, the system can be shut down and the activated carbon can be removed in a batch wise fashion.

In a further alternative, the activated carbon of the nitrogen removal system 16 can undergo regeneration where the activated carbon is significantly freed of adsorbed nitrogen components. In one embodiment, the spent carbon is allowed to flow from nitrogen removal system 16 to the regeneration unit 20 via connection 18. Possible mechanisms for travel of the activated carbon from nitrogen removal system 16 to regeneration unit 20 include either a gravity-induced flow or a pressurized flow arrangement for transport of the spent activated carbon to regeneration unit 20. Alternatively, the static bed containing the spent activated carbon can be completely taken off line and the spent activated carbon can be removed in a batch-wise fashion and inserted into the regeneration system 20.

In one embodiment of the regeneration system 20, the nitrogen removal system utilizes a thermal regeneration technique to reactivate the spent activated carbon. Specifically, the regeneration unit may include a furnace or rotary kiln arrangement for the thermal vaporization of adsorbents on the activated carbon. Typical temperatures for vaporizing the absorbed molecules can range from about 400° C. up to about 1000° C. In one embodiment, the absorbed molecules are vaporized at a temperature of no more than about 900° C. In another embodiment, the temperature may range from about 400° C. up to about 600° C. In a further embodiment, the temperature may range from about 700° C. to about 1000° C. Alternatively, the spent activated carbon can be stripped by steam for the removal of contaminants. In steam stripping regeneration the temperature of the steam can vary from about 100° C. up to about 900° C. for the removal of most adsorbents.

With the above regeneration techniques the activated carbon will eventually have to be replaced, as the thermal regeneration techniques as well as the steam regeneration techniques do oxidize a portion of the activated carbon each time. Approximately 10% by weight of the activated carbon is lost during each thermal regeneration while about 5% by weight of the activated carbon is lost when utilizing steam regeneration techniques.

In an alternative embodiment of the nitrogen removal system 16, a variety of inorganic adsorbents can be used in a column type arrangement to function as nitrogen removal system still under mild conditions or at least temperatures much lower than prior art processes. The adsorbents can be of a variety of high surface area materials, which include preferably activated alumina, gamma alumina, amorphous alumina, titania, zirconia, silica gel, charged silica, zeolite, and a variety of high surface area active metal oxides including those of nickel, copper, iron and so on. These materials with their high surface areas provide a large number of active sites for the removal of nitrogen components from the coal tar feedstock.

Specifically, gamma alumina can have a surface area of from about 1 $m^2/g$ to over 100 $m^2/g$, is quite rigid and can be formed in a variety of shapes for placement within the nitrogen removal system 16. These shapes include a variety of sized pellets, honeycomb, helical, and a variety of polygonal arrangements typical for fixed bed reactors.

The alumina adsorbents with an appropriate pore size and surface area for the adsorption of nitrogen components can be used in different forms and shapes including, but not limited to a variety of sized pellets, honeycomb, helical, and a variety of polygonal arrangements typical for use in fixed bed columns. Other commercial adsorbents such as silica gels, silica/alumina and xeolites can similarly be used in fixed bed columns. Such adsorbents, which are generally used in analytical separations, are readily available from commercial sources such as Aldrich Chemical Co.

Similar to activated carbon, inorganic adsorbents such as activated alumina can also be recycled as their disposal would be quite costly in the production of reduced-puffing needle coke. Larger contaminants can be removed through a steam stripping process wherein the adsorbent material is exposed to steam in a temperature range of from about 100° C. to about 500° C. and a pressure of from about 10 psig to about 50 psig. In certain embodiments the upper temperature range may exceed 500° C. if the removal of higher boiling point contaminants would be beneficial. Any contaminants not removed from the adsorbent can be removed through a subsequent thermal treatment to regenerate the adsorption activity. The thermal treatment process includes temperatures in the range of from about 500° C. to about 900° C. Total processing time for regeneration is dependant upon the selected thermal treatment temperature allowing the user to optimize the regeneration specific to the overall needle coke production process. Over repeated regenerations, the adsorbent will lose activity and require its replacement or reconstruction.

Upon exiting the nitrogen removal system 16, the treated coal tar feedstock stream 24 is directed to the coking unit 26. A variety of methods exist for coking a coal tar feedstock, with delayed coking being the most common method for creating needle coke.

A standard delayed coking unit preferably comprises two or more needle coke drums operated in a batch-continuous process. Typically, one portion of the drums is filled with feedstock while the other portion of the drums undergoes thermal processing.

Prior to a needle coke drum being filled; the drum is preheated, by thermal gases recirculated from the coking occurring in the other set of needle coke drums. The heated drums are then filled with preheated coal tar feedstock wherein the liquid feedstock is injected into the bottom portion of the drum and begins to boil. With both the temperature and pressure of the coking drum increasing, the liquid feedstock becomes more and more viscous. The coking process occurs at temperatures of from about 450° C. to about 500° C. and pressures from about ambient up to about 100 psig. Slowly, the viscosity of the treated coal tar feedstock increases and begins to form needle coke.

The coke produced by the aforementioned process is then calcined at temperatures up to or about 1400° C. The calcined reduced puffing needle coke preferably has a CTE below about 2.0 cm/cm/° C.*$10^{-7}$, more preferably below about 1.25 cm/cm/° C.*$10^{-7}$, and most preferably below about 1.0 cm/cm/° C.*$10^{-7}$. Furthermore, the calcined reduced puffing needle coke has less than about 0.4% by weight, more typically about 0.2% by weight, and most preferably down to or less than about 0.03% by weight nitrogen content while having less than about 1.0% by weight sulfur content, and the needle coke exhibits very little nitrogen-induced physical expansion during graphitization to temperatures well above 2000° C.

The disclosures of all cited patents and publications referred to in this application are incorporated herein by reference.

The above description is intended to enable the person skilled in the art to practice the invention. It is not intended to detail all of the possible variations and modifications that will become apparent to the skilled worker upon reading the description. It is intended, however, that all such modifications and variations be included within the scope of the invention that is defined by the following claims. The claims are intended to cover the indicated elements and steps in any arrangement or sequence that is effective to meet the objectives intended for the invention, unless the context specifically indicates the contrary.

What is claimed is:

1. A calcined reduced puffing needle coke derived from coal tar comprising needle coke with a nitrogen content of less than about 0.2% nitrogen and a coefficient of thermal expansion of below about 2.0 cm/cm ° C.*$10^{-7}$.

2. The needle coke of claim 1, which has a coefficient of thermal expansion below about 1.25 cm/cm ° C.*$10^{-7}$.

3. The needle coke of claim 2, which has a coefficient of thermal expansion below about 1.0 cm/cm ° C.*$10^{-7}$.

4. The needle coke of claim 1, which has a nitrogen content of from about 0.03% to less than about 0.2% by weight and a sulfur content of less than about 1.0% by weight.

5. A graphite electrode formed using a calcined reduced puffing needle coke derived from coal tar comprising needle coke with a nitrogen content of less than about 0.4% nitrogen and a coefficient of thermal expansion of below about 2.0 cm/cm ° C.*$10^{-7}$.

6. The graphite electrode of claim 5, formed using a calcined reduced puffing needle coke derived from coal tar comprising needle coke with a nitrogen content of less than about 0.4% nitrogen and needle cokes not derived from coal tar comprising needle coke with a nitrogen content of less than about 0.4% nitrogen.

* * * * *